US010371367B2

(12) United States Patent
Ouellet et al.

(10) Patent No.: US 10,371,367 B2
(45) Date of Patent: Aug. 6, 2019

(54) LED LIGHTING FIXTURE HAVING A HEAT DISSIPATING FEATURE

(71) Applicants: Bertrand Ouellet, Carignan (CA); Nicole Tremblay, Carignan (CA)

(72) Inventors: Bertrand Ouellet, Carignan (CA); Nicole Tremblay, Carignan (CA)

( * ) Notice: Subject to any disclaimer, the term of this patent is extended or adjusted under 35 U.S.C. 154(b) by 0 days.

(21) Appl. No.: 15/479,329

(22) Filed: Apr. 5, 2017

(65) Prior Publication Data

US 2017/0284649 A1 Oct. 5, 2017

(30) Foreign Application Priority Data

Apr. 5, 2016 (GB) ..... 1605831.5

(51) Int. Cl.

| | |
|---|---|
| ***F21V 29/70*** | (2015.01) |
| ***F21V 29/89*** | (2015.01) |
| ***F21K 9/235*** | (2016.01) |
| ***F21K 9/237*** | (2016.01) |
| ***F21V 3/00*** | (2015.01) |
| ***F21V 17/02*** | (2006.01) |
| ***F21V 17/12*** | (2006.01) |
| ***F21V 23/06*** | (2006.01) |
| ***F21V 31/00*** | (2006.01) |
| *F21Y 115/10* | (2016.01) |
| *F21V 19/02* | (2006.01) |
| *F21V 23/00* | (2015.01) |

(52) U.S. Cl.

CPC ..... *F21V 29/70* (2015.01); *F21K 9/235* (2016.08); *F21K 9/237* (2016.08); *F21V 3/00* (2013.01); *F21V 17/02* (2013.01); *F21V 17/12* (2013.01); *F21V 23/06* (2013.01); *F21V 29/89* (2015.01); *F21V 31/005* (2013.01); *F21V 19/02* (2013.01); *F21V 23/002* (2013.01); *F21Y 2115/10* (2016.08)

(58) Field of Classification Search

CPC ..... F21V 29/70; F21V 29/89

See application file for complete search history.

(56) References Cited

U.S. PATENT DOCUMENTS

| | | | | |
|---|---|---|---|---|
| 3,104,064 A | | 9/1963 | Bellek | |
| 3,766,377 A | * | 10/1973 | Junginger | F21V 29/02 362/232 |
| 4,008,910 A | | 2/1977 | Roche | |
| 5,450,303 A | | 9/1995 | Markiewicz et al. | |
| 6,161,948 A | | 12/2000 | Hagen | |

(Continued)

OTHER PUBLICATIONS

English Abstract of DE 202006005514 U1 (Year: 2006).*

*Primary Examiner* — Charlie Y Peng

(57) ABSTRACT

A lighting fixture comprising a hollow body member having a proximal end and a distal end, wherein the hollow body member includes a heat dissipating feature at the distal end; a socket having a cavity, wherein the socket provides electrical current to a LED bulb having a base portion, wherein the base portion is encased inside the cavity; a biasing member having a first end and a second end, wherein the first end contacts the socket and is configured to push the LED bulb into the heat dissipating feature; a base member having a seat configured and sized to accept the second end of the biasing member, and a channel allowing the passage of electrical wires through the base member to the socket.

11 Claims, 2 Drawing Sheets

(56) References Cited

U.S. PATENT DOCUMENTS

| | | | | |
|---|---|---|---|---|
| 6,435,699 | B2 * | 8/2002 | Glowach, Sr. | F21V 29/02 362/294 |
| 6,481,875 | B1 * | 11/2002 | Bryant | F21V 17/06 362/123 |
| 6,966,679 | B2 | 11/2005 | Matts et al. | |
| 7,137,721 | B1 | 11/2006 | Rao et al. | |
| 7,540,761 | B2 | 6/2009 | Weber et al. | |
| 7,866,850 | B2 * | 1/2011 | Alexander | F21V 19/001 362/294 |
| 7,942,556 | B2 * | 5/2011 | Harbers | F21K 9/54 362/230 |
| 8,152,341 | B2 * | 4/2012 | Wheelock | F21V 31/04 362/249.02 |
| 8,430,535 | B2 | 4/2013 | Watanabe et al. | |
| 9,854,636 | B2 * | 12/2017 | Abele | H05B 33/0854 |
| 2002/0093279 | A1 * | 7/2002 | Chen | F21V 19/0095 313/318.01 |
| 2004/0212991 | A1 | 10/2004 | Galli | |
| 2010/0141108 | A1 * | 6/2010 | Liu | F21K 9/00 313/12 |

* cited by examiner

LED LIGHTING FIXTURE HAVING A HEAT DISSIPATING FEATURE

CROSS-REFERENCE TO RELATED APPLICATIONS

The present application claims priority to United Kingdom Patent Application serial number 1605831.5, filed on Apr. 5, 2016 entitled "LED lighting fixture having a heat dissipating feature", the disclosure of which is hereby incorporated in its entirety at least by reference.

BACKGROUND OF THE INVENTION

1. Field of the Invention

The present invention generally relates to lighting fixtures, but more particularly to a LED lighting fixture having a heat dissipating feature.

2. Description of Related Art

Even though light-emitting diodes (LEDs) emit less heat than incandescent light bulbs, they still emit heat, and the heat needs to be evacuated. The dissipating of heat is critical when a LED is inside a sealed fixture, such as an outdoor light fixture. Consequently, there is a need for a LED lighting fixture having a heat dissipating feature.

BRIEF SUMMARY OF THE INVENTION

In one embodiment of the present invention a lighting fixture is provided, comprising a hollow body member having a proximal end and a distal end, wherein the hollow body member includes a heat dissipating feature at the distal end; a socket having a cavity, wherein the socket provides electrical current to a LED bulb having a base portion, wherein the base portion is encased inside the cavity; a biasing member having a first end and a second end, wherein the first end contacts the socket and is configured to push the LED bulb into the heat dissipating feature; a base member having a seat configured and sized to accept the second end of the biasing member, and a channel allowing the passage of electrical wires through the base member to the socket.

In one embodiment, the hollow body member is cylindrical. In one embodiment, the hollow body member is constructed from a thermal conducting material, including but not limited to a metal. In another embodiment, the biasing member is a coil spring. In one embodiment, the base member is configured to swivel. In yet another embodiment, the base member is rotationally connected to a connection member and a first O-ring is positioned between the base member and connection member to provide a watertight seal. In one embodiment, the proximal end of the body member includes internal threads configured for engagement with external threads on the base member, and a second O-ring is positioned between the body member and base member to provide a watertight seal preventing water from damaging electrical components.

In one embodiment, a lens member and a shade member attached to the distal end of the body member are provided to create a desired lighting effect. In one embodiment, the socket has a pair of grooves and the base member has a pair of holes allowing dog points from two socket head cap screws to pass through the pair of holes into the pair of grooves, wherein the dog points are in a sliding engagement with the pair of grooves preventing the socket from rotating and ensuring the socket is aligned properly to prevent twisting of electrical wires. In another embodiment, the base portion of the LED bulb includes bi-pins, and the base portion and bi-pins extend integrally from the LED bulb, wherein the base portion and bi-pins are encased in the cavity to prevent the bi-pins from breaking off the base portion. In one embodiment, the socket includes a side hole located on a side wall of the socket, the side hole configured to receive a single socket head cap screw to align the socket with the bi-pins of the base portion. In one embodiment, the heat dissipating feature is a flange located on a distal end of the body member.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
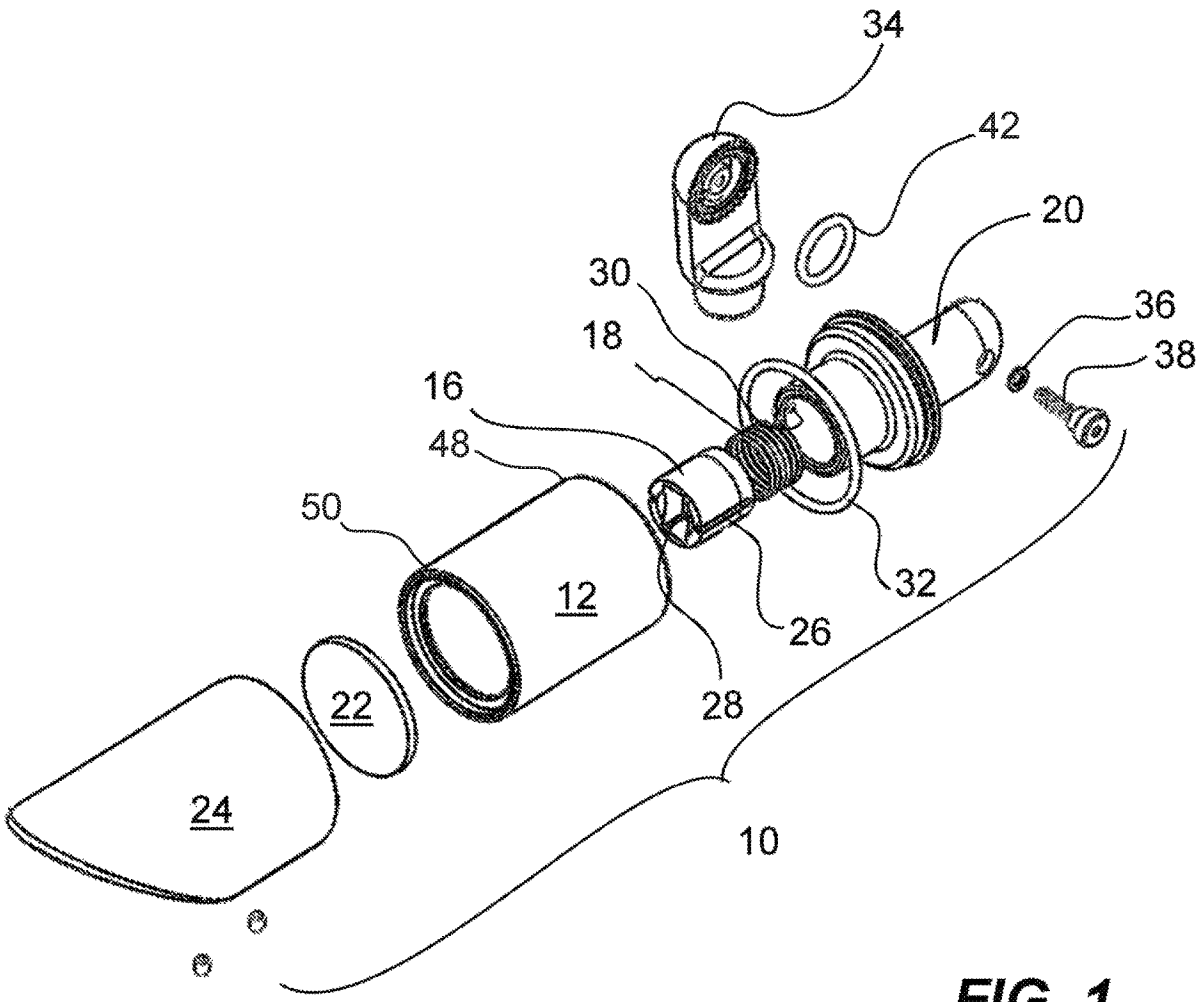
FIG. 1 is a perspective exploded view a LED lighting fixture having a heat dissipating feature according to an embodiment of the present invention.

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a LED lighting fixture having a heat dissipating feature according to an embodiment of the present invention.

It is a particular advantage of the invention to provide a LED lighting fixture 10 having a heat dissipating feature. The invention comprises a biasing member 18 configured to push a socket 16 in which an LED bulb 14 is connected, wherein the LED bulb 14 is pushed against a metal part which forms part of the lighting fixture's body member 12. This is a particular advantage of the invention, as the metal part provides heat to be conducted to the outside of the fixture's body member 12 allowing the heat to dissipate into the environment.

FIG. 1 is a perspective exploded view of an LED lighting fixture 10 having a heat dissipating feature according to an embodiment of the present invention. Referring now to FIG. 1, an LED lighting fixture 10 comprises a body member 12, socket 16, biasing member 18, and base member 20. In one embodiment, the body member 12 is hollow and cylindrical. In one embodiment, the body member 12 is constructed from a heat conducting material, such as metal. The socket 16 has a cavity 28 and provides electrical current to an LED bulb 14 (FIG. 2), as is well known in the art. In one embodiment, the biasing member 18 is a coil spring. The biasing member 18 is configured to push the socket 16 against the inside of the body member 12. In one embodiment, the base member 20 is configured to swivel. In another embodiment, the base member 20 is rotationally connected a connection member 34, allowing the LED lighting fixture 10 to rotate and be connected to a structure as well known in the art. In one embodiment, the connection member 34 is attached to the base member 20 via the combination of a screw 38 and washer 36, or any connection means as known in the art. In one embodiment, a first O-ring 42 is used to provide a watertight seal between the connection member 34 and base member 20.

Still referring to FIG. 1, the LED lighting fixture 10 includes a lens member 22, and shade member 24. The lens member 22 and shade member 24 are configured to attach to the body member 12, and provide a desired lighting effect as well known in the art. It should be understood, that any modification and variation can be made to the lens 22 and shade members 24 without departing from the spirit and scope of the invention. In one embodiment, at a proximal end 48 of the body member 12 internal threads are provided for screw engagement with external threads on the base member 20. In one embodiment, a second O-ring 32 is positioned between the body member 12 and base member 20, to provide a watertight seal preventing rainfall and/or other water sources from damaging electrical components.

In one embodiment, the socket 16 has at least one groove 26 to allow at least one dog point from a socket head cap screws (not illustrated) to pass through at least one hole 30 (best seen in FIG.2) located on base member 20, to slide along the at least one groove 26. In a preferred embodiment, a pair of grooves 26 is provided with two dog points from two socket head cap screws corresponding with a pair of holes 30. This prevents the socket 16 from rotating during the screwing and unscrewing of the body member 12 from the base member 20, as well as ensuring the socket 16 is aligned properly, and to prevent the twisting of electrical wires.

Figure 2:
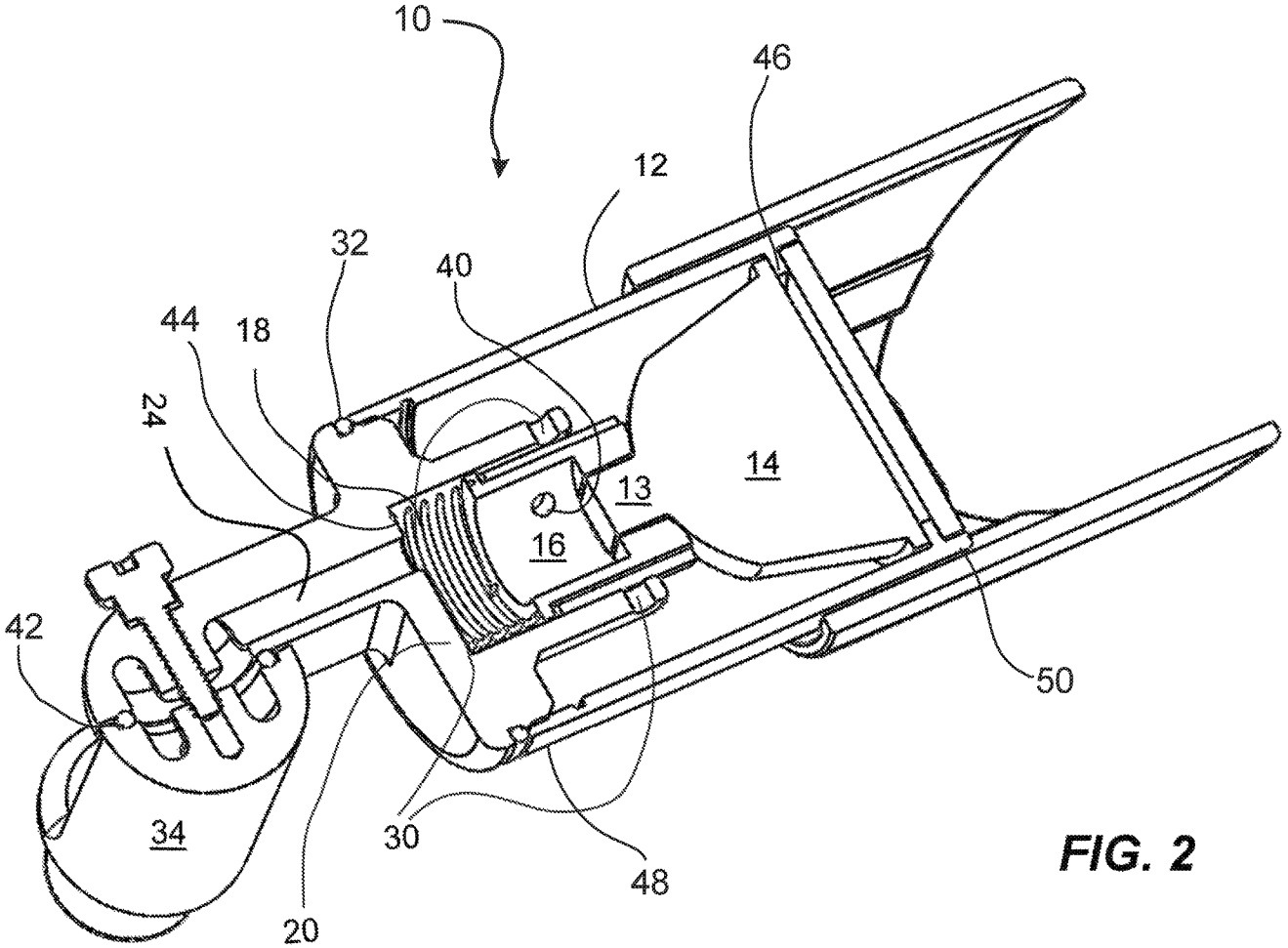
FIG. 2 is a sectional view showing components of a LED lighting fixture having a heat dissipating feature according to an embodiment of the present invention.

FIG. 2 is a sectional view showing components of an LED lighting fixture 10 having a heat dissipating feature according to an embodiment of the present invention. Referring to FIG. 2, the lighting fixture 10 is illustrated. When the LED lighting fixture 10 is assembled, a first end of the biasing member 18 makes contact with the socket 16, while a second end of the biasing member 18 rests in a seat 44 of the base member 20. A channel 24 is provided to allow the passage of electrical wires through the base member to the socket.

During use, a user may remove the body member from the base member by unscrewing the body member from the base member to access the internals for either for a bulb replacement or first time installation of a LED bulb 14. During installation, the LED bulb is pressed into the cavity of the socket to protect a base portion 13 of the LED bulb. The base portion includes ceramic bi-pins (not illustrated) configured for electrical contact as well known in the art. In one embodiment, the base portion is constructed from a polymer. The base portion and bi-pins extend integrally from the LED bulb, encased inside the cavity. It is critical that the bi-pins are well protected by cavity, preventing the bi-pins from breaking off the base portion. Further, the pressure exerted by biasing member 18 and the rotational force exerted on the LED bulb by a heat dissipating feature 46 of the body member during installation would damage the base portion as well as the bi-pins, since the base portion and bi-pins are fragile elements, thus it is critical they are well encased inside the cavity. The heat dissipating feature provides heat to be conducted to the outside of body member allowing the heat to dissipate into the environment. In one embodiment, the heat dissipating feature is a flange located on a distal end 50 of the body member 12. The flange is integrally connected to the body member 12.

As previously mentioned, the socket 16 has a pair of grooves 26, to allow dog points from two socket head cap screws passing through holes 30 located on base member 20, to slide along the pair of grooves 26. This prevents the socket 16 from rotating during the screwing and unscrewing of the body member 12 from the base member 20, as well as ensuring the socket 16 is aligned properly, and to prevent the twisting of electrical wires. In one embodiment, the socket 16 has a side hole 40 located on a side wall, wherein another socket head cap screw (not illustrated) is inserted. The cap screw is configured to correctly align the socket 16 with the bi-pins of the LED bulb.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A lighting fixture comprising:

a hollow body member having a proximal end and a distal end, wherein the hollow body member includes a heat dissipating feature at the distal end;

a socket having a cavity, wherein the socket provides electrical current to a LED bulb having a base portion, wherein the base portion is encased inside the cavity;

a biasing member having a first end and a second end, wherein the first end contacts the socket and is configured to push the LED bulb into the heat dissipating feature;

a base member having a seat configured and sized to accept the second end of the biasing member, and a channel allowing the passage of electrical wires through the base member to the socket; the socket has a pair of grooves and the base member has a pair of holes allowing dog points from two socket head cap screws to pass through the pair of holes into the pair of grooves, wherein the dog points are in a sliding engagement with the pair of grooves preventing the socket from rotating and ensuring the socket is aligned properly to prevent twisting of electrical wires.

2. The lighting fixture of claim 1, wherein the hollow body member is cylindrical.

3. The lighting fixture of claim 1, wherein the hollow body member is constructed from a thermal conducting material, including but not limited to a metal.

4. The lighting fixture of claim 1, wherein the biasing member is a coil spring.

5. The lighting fixture of claim 1, wherein the base member is configured to swivel.

6. The lighting fixture of claim 5, wherein the base member is rotationally connected to a connection member and a first O-ring is positioned between the base member and connection member to provide a watertight seal.

7. The lighting fixture of claim 1, wherein the proximal end of the body member includes internal threads configured for engagement with external threads on the base member, and a second O-ring is positioned between the body member and base member to provide a watertight seal preventing water from damaging electrical components.

8. The lighting fixture of claim 1, further comprising a lens member and a shade member attached to the distal end of the body member to provide a desired lighting effect.

9. The lighting fixture of claim 1, wherein the base portion of the LED bulb includes bi-pins, and the base portion and bi-pins extend integrally from the LED bulb, wherein the base portion and bi-pins are encased in the cavity to prevent the bi-pins from breaking off the base portion.

10. The lighting fixture of claim 9, wherein the socket includes a side hole located on a side wall of the socket, the side hole configured to receive a single socket head cap screw to align the socket with the bi-pins of the base portion.

11. The light fixture of claim 1, wherein the heat dissipating feature is a flange located on a distal end of the body member.

* * * * *